US011373796B2

(12) United States Patent
Otsubo et al.

(10) Patent No.: US 11,373,796 B2
(45) Date of Patent: Jun. 28, 2022

(54) INDUCTOR COMPONENT AND METHOD FOR MANUFACTURING INDUCTOR COMPONENT

(71) Applicant: Murata Manufacturing Co., Ltd., Kyoto (JP)

(72) Inventors: Yoshihito Otsubo, Kyoto (JP); Mitsuyoshi Nishide, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1028 days.

(21) Appl. No.: 16/027,504

(22) Filed: Jul. 5, 2018

(65) Prior Publication Data

US 2018/0315543 A1 Nov. 1, 2018

Related U.S. Application Data

(63) Continuation of application No. PCT/JP2017/000078, filed on Jan. 5, 2017.

(30) Foreign Application Priority Data

Jan. 6, 2016 (JP) ..... JP2016-000869

(51) Int. Cl.
*H01F 27/28* (2006.01)
*H01F 27/29* (2006.01)
(Continued)

(52) U.S. Cl.
CPC ..... *H01F 27/29* (2013.01); *H01F 17/0013* (2013.01); *H01F 17/0033* (2013.01);
(Continued)

(58) Field of Classification Search
USPC ..... 336/192, 200, 232, 198
See application file for complete search history.

(56) References Cited

U.S. PATENT DOCUMENTS 7,196,607 B2 * 3/2007 Pleskach ..... H01F 17/0033 336/200
2009/0002111 A1 * 1/2009 Harrison ..... H01F 19/04 336/69
(Continued)

FOREIGN PATENT DOCUMENTS

JP 2013-140957 A 7/2013
WO 2015/133361 A1 9/2015
(Continued)

OTHER PUBLICATIONS

International Search Report for International Application No. PCT/JP2017/000078, dated Feb. 28, 2017.
(Continued)

*Primary Examiner* — Shawki S Ismail
*Assistant Examiner* — Kazi S Hossain
(74) *Attorney, Agent, or Firm* — Pearne & Gordon LLP

(57) ABSTRACT

An inductor component 1 includes a resin layer 2, a protective film 4, two metal pins 5 provided to stand in the resin layer 2, and a metal plate 6 joined to both of the metal pins 5, and both of the metal pins 5 and the metal plate 6 configure an inductor electrode 7. Both of the metal pins 5 are provided to stand in the resin layer 2, upper end surfaces 5*a* thereof are exposed to an upper surface 2*a* of the resin layer 2, and lower end surfaces 5*b* thereof are exposed to a lower surface 2*b*. Recesses 8 are formed around the peripheral edges of the upper end surfaces 5*a* of both of the metal pins 5 by laser beam irradiation.

4 Claims, 6 Drawing Sheets

(51) Int. Cl.

| | |
|---|---|
| ***H01F 41/04*** | (2006.01) |
| ***H01F 17/00*** | (2006.01) |
| ***H01F 17/06*** | (2006.01) |
| ***H01F 27/32*** | (2006.01) |
| ***H01F 41/02*** | (2006.01) |

(52) U.S. Cl.
CPC ..... *H01F 17/062* (2013.01); *H01F 27/324* (2013.01); *H01F 41/02* (2013.01); *H01F 41/041* (2013.01); *H01F 2017/002* (2013.01)

(56) References Cited

U.S. PATENT DOCUMENTS

2013/0168144 A1 7/2013 Jeong et al.
2014/0111273 A1* 4/2014 Jou ..... H01L 24/18 327/564
2015/0101854 A1* 4/2015 Lee ..... H01F 41/046 174/260
2016/0254089 A1* 9/2016 Parish ..... H01F 27/2895 336/199
2016/0372259 A1* 12/2016 Banba ..... H01F 17/062
2017/0004914 A1 1/2017 Nishide et al.
2017/0084384 A1 3/2017 Otsubo et al.
2018/0330870 A1* 11/2018 Sakai ..... H01F 17/04

FOREIGN PATENT DOCUMENTS

WO 2015/141434 A1 9/2015
WO 2015/190229 A1 12/2015

OTHER PUBLICATIONS

Written Opinion for International Application No. PCT/JP2017/000078, dated Feb. 28, 2017.

* cited by examiner

FIG. 2A
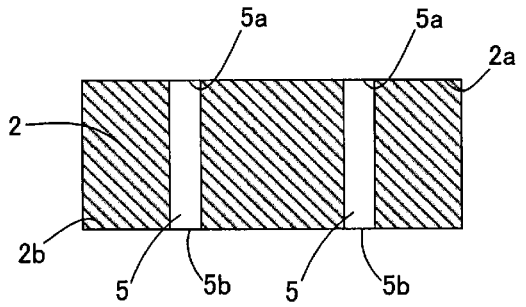
FIG. 2B
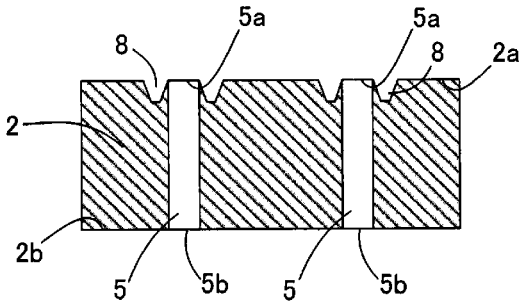
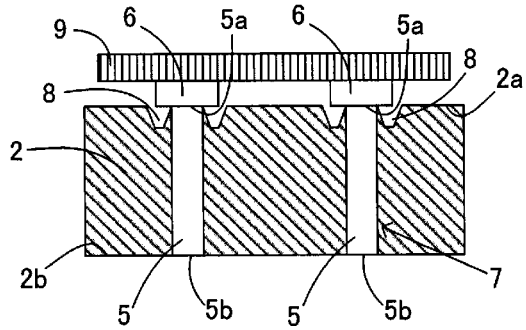
FIG. 2C
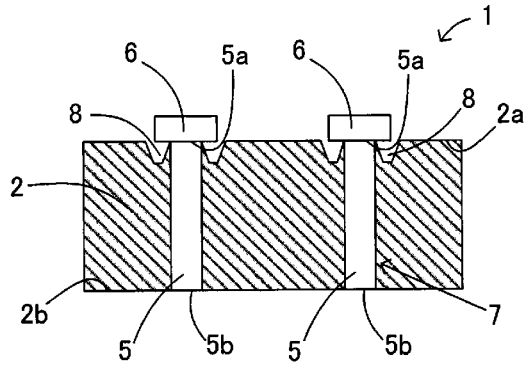
FIG. 2D
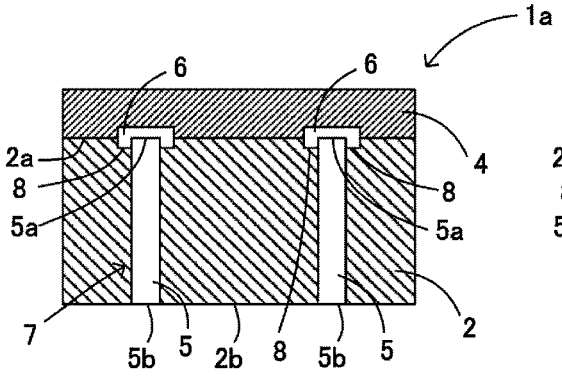
FIG. 3A
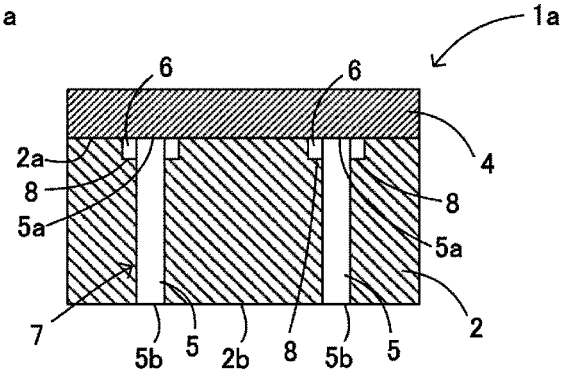
FIG. 3B

INDUCTOR COMPONENT AND METHOD FOR MANUFACTURING INDUCTOR COMPONENT

This is a continuation of International Application No. PCT/JP2017/000078 filed on Jan. 5, 2017 which claims priority from Japanese Patent Application No. 2016-000869 filed on Jan. 6, 2016. The contents of these applications are incorporated herein by reference in their entireties.

BACKGROUND OF THE DISCLOSURE

Field of the Disclosure

The present disclosure relates to an inductor component including an inductor provided in or on an insulator and a method for manufacturing the same.

Description of the Related Art

An existing inductor component in which an inductor electrode is provided in or on an insulator such as a resin layer has been known. Some inductor electrodes provided in an inductor component of this type include a via conductor formed in a resin layer and a wiring pattern formed on a main surface of the resin layer. In this case, the via conductor and the wiring pattern are generally formed with conductive paste or plating. In order to improve the characteristics (for example, an inductance value) of an inductor electrode and reduce the manufacturing cost thereof, the inventors have studied that the inductor electrode is formed using a metal pin instead of the via conductor and using a metal plate for wiring instead of the wiring pattern. With this configuration, it is possible to improve the characteristics of the inductor component because the resistance of the inductor electrode overall can be reduced. Further, it is possible to reduce the manufacturing cost of the inductor component because a process for forming a via hole and a process for plating become unnecessary.

Patent Document 1 has proposed a method as illustrated in FIG. 7 as a method for joining a conductive post and a metal plate to each other. That is to say, Patent Document 1 has proposed a method in which in a printed circuit board 100, metal pins 140 made of a conductive material are arranged on a base substrate 110 having electrode pads 120 and resist 130 with openings for exposing the electrode pads 120 therefrom, and the electrode pads 120 and the metal pins 140 are joined to each other by applying energy thereto. In this case, the metal pins 140 cut to have a desired height are joined to the electrode pads 120, so that a fine pitch can be set and conductive posts having a large aspect ratio can be easily realized.

Patent Document 1: Japanese Unexamined Patent Application Publication No. 2013-140957 (paragraphs 0060 to 0073, FIG. 6, and the like)

BRIEF SUMMARY OF THE DISCLOSURE

Although the metal pins are fixed by jigs, and then, ultrasonic joining is performed in the above-described existing joining method, it can also be considered that the metal pins in a state in which the end surfaces are exposed to a main surface of a resin layer are arranged in the resin layer and fixed, and then, the ultrasonic joining is performed. However, it has been found from studies by the present inventors that with such a joining method, the presence of the resin on the peripheral surfaces of the joint portions between the metal plate and the metal pins causes the vibration energy of ultrasonic waves to be transmitted to the surrounding resin and easily escape. As a result, the energy necessary for joining the metal pins and the metal plate cannot be obtained, which may lead to difficulty in joining or lower the joining strength.

The present disclosure has been made in view of the above-described problem and an object thereof is to provide an inductor component using a metal plate for a wiring to reduce the resistance thereof, and making joining between a metal pin and the metal plate easy and increasing the joining strength when the metal plate is used for the wiring.

In order to achieve the above object, an inductor component according to an aspect of the present disclosure includes a resin layer and an inductor electrode, wherein the inductor electrode has a metal pin provided to stand in the resin layer in a state in which an end surface of the metal pin is exposed to a main surface of the resin layer, and a metal plate for wiring, which makes contact with the end surface of the metal pin, and the metal pin is disposed such that the end surface protrudes to at least a part of the main surface of the resin layer around a peripheral edge of the end surface of the metal pin.

In the inductor component configured as described above, the inductor electrode is configured by the metal plate such as a lead frame and the metal pin, so that the resistance of the inductor electrode can be reduced as compared with an existing configuration formed by conductive paste or plating. Further, as compared with the existing configuration, it is possible to reduce the connection resistance between a portion of the inductor electrode, which is formed on the main surface of the resin layer, and a portion thereof, which is formed in the resin layer, and suppress the heat generation in a joint portion of them. In addition, manufacturing can be performed in a short period of time and the manufacturing cost can be reduced as compared with the case in which the inductor electrode is formed using the conductive paste or plating. The metal pin is disposed such that the end surface thereof protrudes to at least a part of the main surface of the resin layer around the peripheral edge of the end surface of the metal pin. Therefore, when the metal pin and the metal plate are joined to each other by ultrasonic waves, for example, the vibration energy in joining can be suppressed from being transmitted to the resin layer. Therefore, the metal pin and the metal plate can be securely joined to each other, and the joining strength can be increased.

Further, an end portion of the metal pin, which includes the end surface, may protrude from the main surface of the resin layer. In this case, the metal pin protrudes from the main surface of the resin layer. Therefore, the vibration energy in the ultrasonic joining can be efficiently applied to the joint portion between the metal pin and the metal plate, and the metal pin and the metal plate can be easily positioned in the joining.

In addition, a recess may be formed in at least a part of the main surface of the resin layer around the peripheral edge of the end surface of the metal pin. In this case, the resin around the peripheral edge of the metal pin can be removed by irradiating the periphery of the end surface of the metal pin exposed to the main surface of the resin layer with a laser beam, thereby making manufacturing easy.

In addition, solder may be arranged in the recess. In this case, the recess serves as a solder receiver, so that the solder can be prevented from spreading.

Further, a method for manufacturing an inductor component according to another aspect of the present disclosure includes preparing a metal pin provided to stand in a resin layer in a state in which an end surface of the metal pin is exposed to a main surface of the resin layer, forming a recess by irradiating at least a part of the main surface of the resin layer around a peripheral edge of the end surface of the metal pin with a laser beam, and forming an inductor electrode having the metal pin and a metal plate for wiring by joining the end surface of the metal pin and the metal plate.

With this configuration, the inductor electrode can be formed using the metal pin and the metal plate. Therefore, it is possible to manufacture the inductor component including the inductor electrode having a low resistance value and excellent characteristics of an inductance value, for example, as compared with the case in which an inductor electrode is formed by conductive paste or plating. In addition, the formation of the recess around the peripheral edge of the metal pin can increase the joining strength between the metal pin and the metal plate, thereby forming the inductor electrode with high connection reliability.

In addition, in the forming of the inductor electrode, the end surface of the metal pin and the metal plate may be joined to each other by ultrasonic waves. In this case, it is possible to manufacture the inductor component in a short period of time at low cost.

According to the present disclosure, the metal pin configuring a part of the inductor electrode is disposed such that the end surface protrudes to at least a part of the main surface of the resin layer around the peripheral edge of the end surface of the metal pin. Therefore, when the metal pin and the metal plate are joined to each other by the ultrasonic waves, for example, the vibration energy in joining can be suppressed from being transmitted to the resin layer. Therefore, the metal pin and the metal plate can be securely joined to each other, and the joining strength can be increased.

BRIEF DESCRIPTION OF THE SEVERAL VIEWS OF THE DRAWINGS

FIGS. 2A to 2D Each of FIGS. 2A to 2D is a view illustrating an example of a method for manufacturing the inductor component according to the first embodiment of the disclosure.

FIGS. 3A and 3B Each of FIGS. 3A and 3B is a cross-sectional view illustrating a variation of the arrangement of metal pins and a metal plate of the inductor component according to the first embodiment of the disclosure.

DETAILED DESCRIPTION OF THE DISCLOSURE

First Embodiment

Figure 1A:
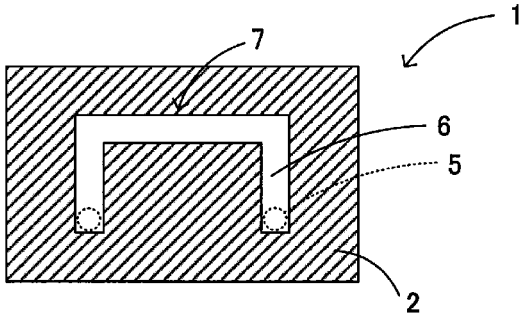
FIGS. 1A to 1E Each of FIGS. 1A to 1E is a plan view and a cross-sectional view of an inductor component according to a first embodiment of the disclosure.

An inductor component 1 according to a first embodiment of the present disclosure will be described with reference to FIGS. 1A to 1E and 2A to 2D. It should be noted that FIG. 1A is a plan view of the inductor component 1, FIGS. 1B to 1E are cross-sectional views of the inductor component 1, and Each of FIGS. 2A to 2D is a view illustrating a manufacturing process of the inductor component 1.

As illustrated in FIGS. 1A to 1E, the inductor component 1 according to this embodiment includes a resin layer 2, a protective film 4 laminated on an upper surface 2*a* of the resin layer 2, two metal pins 5 provided to stand in the resin layer 2, and a metal plate 6 arranged on the upper surface 2*a* of the resin layer 2 and connecting upper end surfaces 5*a* of both of the metal pins 5, and both of the metal pins 5 and the metal plate 6 configure an inductor electrode 7.

The resin layer 2 is made of, for example, a magnetic material-containing resin containing a mixture of thermosetting resin such as epoxy resin and a magnetic filler such as ferrite powder. Note that the resin forming the magnetic material-containing resin is not limited to the thermosetting type, and may be, for example, photocurable resin. Further, it may contain no magnetic filler.

Both of the metal pins 5 are provided to stand in the resin layer 2 such that the upper end surfaces 5*a* (corresponding to an "end surface of a metal pin" in the disclosure) are exposed to the upper surface 2*a* of the resin layer 2 (corresponding to a "main surface of a resin layer" in the disclosure) and lower end surfaces 5*b* are exposed from a lower surface 2*b* of the resin layer 2.

Further, the metal pins 5 are made of a material like Cu, a Cu alloy such as a Cu—Ni alloy and a Cu—Fe alloy, Fe, Au, Ag, Al, or the like. The above-described metal pins 5 are formed by, for example, shearing a wire rod of a metal conductor having a desired diameter and having a circular or polygonal cross-sectional shape into a predetermined length. In other words, both of the metal pins 5 included in the inductor component 1 are formed by a material different from a hardened conductive paste, a plated growth material provided by growing a metal material to a predetermined shape by plating, a sintered body of metal powder, and the like, as with an interlayer connection conductor formed by a via conductor, via-fill plating, or the like. Although in this embodiment, the two metal pins 5 are provided, the number of metal pins 5 can be changed as appropriate. The lower end surfaces 5*b* of both of the metal pins 5 can also be used as outer electrodes.

Figure 1B:
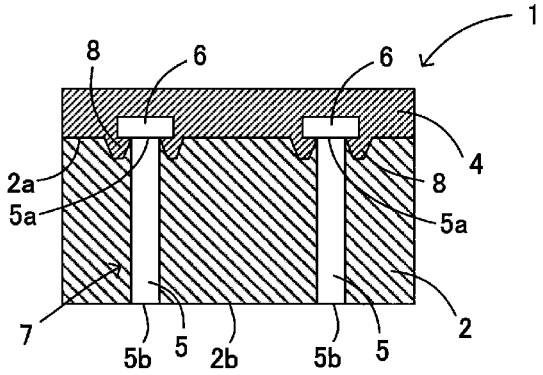

As illustrated in FIG. 1B, recesses 8 are formed in the upper surface 2*a* of the resin layer 2 around the peripheral edges of the upper end surfaces 5*a* of both of the metal pins 5. In this case, both of the metal pins 5 can also be considered to be arranged such that the upper end surfaces 5*a* protrude to the upper surface 2*a* of the resin layer 2 around the peripheral edges of the upper end surfaces 5*a* of the metal pins 5. These recesses 8 can be formed by irradiating the peripheral edges of the upper end surfaces 5*a* of both of the metal pins 5 with a laser beam.

Figure 1C:
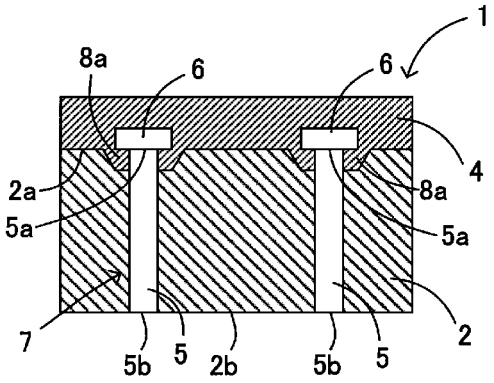
Figure 1D:
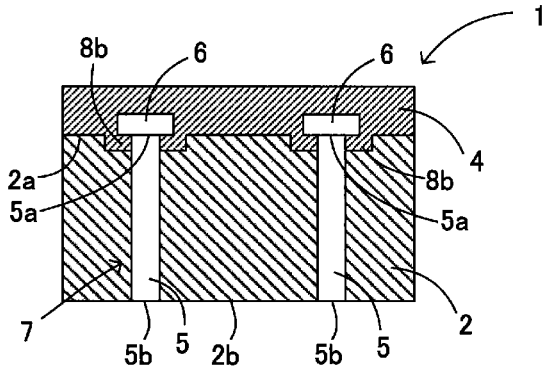
Figure 1E:
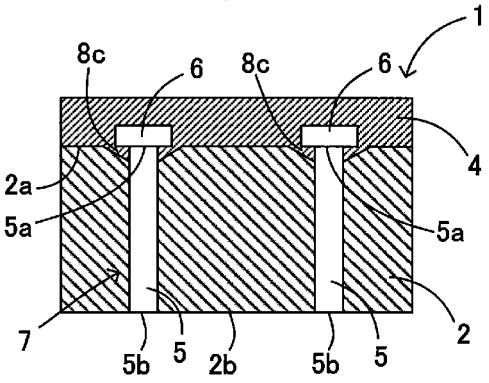

As illustrated in FIGS. 1C to 1E, each recess may have a different shape such as a truncated cone-shaped recess 8*a* (see FIG. 1C), a cylindrical recess 8*b* (see FIG. 1D), and a cone-shaped recess 8*c* (see FIG. 1E) in which an upper end portion of the metal pin 5 is arranged on a center portion. Although each of the recesses 8 and 8*a* to 8*c* is formed around the peripheral edge of the upper end surface 5*a* of the metal pin 5 in the embodiment, it is sufficient that each of the recesses 8 and 8*a* to 8*c* is formed around at least a part of the upper end surface 5*a*. Further, each of the recesses 8 and 8*a* to 8*c* can also be formed by embossing in hardening of the resin instead of the irradiation using the laser beam.

The metal plate 6 is formed by processing a thin plate-like metal material into a predetermined wiring pattern shape like a lead frame, for example, and connects the upper end surfaces 5*a* of both of the metal pins 5 to each other on the upper surface 2*a* of the resin layer 2. The thus connected metal pins 5 and metal plate 6 function as an inductor element in the resin layer 2. Although the metal plate 6 is formed into a U shape (see FIG. 1A) in this embodiment, the shape of the metal plate 6 is not limited thereto.

The protective film 4 is made of, for example, epoxy resin, polyimide, or the like, and is laminated on the upper surface 2*a* of the resin layer 2 to cover the metal plate 6.

(Method for Manufacturing Inductor Component)

Next, a method for manufacturing the inductor component 1 according to this embodiment will be described with reference to FIGS. 2A to 2D. In the following description, one inductor component 1 is manufactured, as an example, for ease of description. Alternatively, the plurality of inductor components 1 may be simultaneously manufactured by collectively forming the plurality of inductor components 1 in the same manner as the manufacturing method, which will be described below, and then, separating it into the individual inductor components 1.

First, the two metal pins 5 are prepared and provided to stand at predetermined positions on a transfer plate or the like (not illustrated). Thereafter, both of the metal pins 5 are covered by the magnetic material-containing resin and the resin is thermally hardened to form the resin layer 2. Then, after the transfer plate is removed, the resin of the upper surface 2*a* and the lower surface 2*b* of the resin layer 2 is polished or ground, so that the upper end surfaces 5*a* and the lower end surfaces 5*b* of both of the metal pins 5 are exposed to the upper surface 2*a* and the lower surface 2*b* of the resin layer 2, respectively (see FIG. 2A). It should be noted that the adjustment of the amount of resin may eliminate the necessity of the process of exposing the end surfaces 5*a* and 5*b* of the metal pins 5 by polishing or grinding in some cases.

Subsequently, as illustrated in FIG. 2B, the recesses 8 are formed by irradiating the peripheral edges of the upper end surfaces 5*a* of both of the metal pins 5 with the laser beam. Since the laser beam has a characteristic of being reflected by the metal pin 5, the metal pin 5 itself remains without being damaged. Therefore, the recesses 8 can be easily formed in the resin layer 2 around the upper end surfaces 5*a* of the metal pins 5. Although a part of the metal pin 5 may be removed depending on the condition of the laser beam, the resin layer 2 is removed deeper than the metal pin 5 also in this case. Accordingly, the recesses are formed in portions of the resin layer 2, which are located around the peripheral edges of the upper end surfaces 5*a* of the metal pins 5.

Then, as illustrated in FIG. 2C, the metal plate 6, which is mounted on a support member 9 and has been processed into a predetermined wiring pattern, is prepared, and the metal plate 6 and the upper end surfaces 5*a* of both of the metal pins 5 are joined to each other by ultrasonic waves to form the inductor electrode 7. Thereafter, as illustrated in FIG. 2D, the support member 9 is removed to complete the inductor component 1. The metal plate 6 is formed by patterning, for example, a flat plate-shaped metal plate by etching or the like. It should be noted that the metal plate 6 and the upper end surfaces 5*a* of both of the metal pins 5 may be joined to each other using solder. In the case of solder joining, the recesses 8 serve as solder receivers, so that the solder can be prevented from spreading into regions other than the joint portions between the metal pins 5 and the metal plate 6. Further, in order to enhance a joint property between the metal plate 6 and the metal pins 5, the ultrasonic joining may be performed in a state in which the solder is arranged between the metal pins 5 and the metal plate 6. In this case, the joint property between the solder and the metal pins is further improved in the ultrasonic joining, and the recesses 8 serve as the solder receivers to prevent the solder from spreading.

According to the above-described embodiment, the inductor electrode 7 is configured by the metal plate 6 such as the lead frame and the metal pins 5, so that the resistance of the inductor electrode 7 can be reduced as compared with the existing configuration formed by conductive paste or plating. Further, as compared with the existing configuration, the connection resistance between a portion of the inductor electrode 7, which is formed on the main surface, and a portion thereof, which is formed in the resin layer 2, can be reduced, and the heat generation can be suppressed in a joint portion of them. In addition, manufacturing can be performed in a short period of time and the manufacturing cost can be reduced as compared with the case in which the inductor electrode is formed using the conductive paste or plating. The upper end surfaces 5*a* of both of the metal pins 5 are disposed so as to protrude to the upper surface 2*a* of the resin layer 2 around the peripheral edges of the end surfaces of the metal pins 5. Therefore, the vibration energy in the ultrasonic joining can be suppressed from being transmitted to the resin layer 2. Accordingly, the metal pins 5 and the metal plate 6 can be securely joined to each other, and the joining strength can be increased.

(Variations of Joint Portions Between Metal Pins and Metal Plate)

Variations of the joint portions between both of the metal pins 5 and the metal plate 6 will be described with reference to FIGS. 3A and 3B. FIG. 3A is a cross-sectional view of an inductor component 1*a* and FIG. 3B is a cross-sectional view of the inductor component 1*a*.

As illustrated in FIGS. 3A and 3B, the metal plate 6 may be connected to the metal pins 5 in a state in which a part or all thereof enters the recesses 8 in the resin layer 2 by adjusting the depth of the recess 8, 8*a*, 8*b* or 8*c* formed around the peripheral edges of the upper end surfaces 5*a* of both of the metal pins 5 and the intensity of the energy in the ultrasonic joining.

FIG. 3A illustrates a state in which a part of the metal plate 6 enters the recesses 8 in the resin layer 2 with the vibration energy in the ultrasonic joining. Both of the metal pins 5 are more difficult to be deformed rather than the metal plate 6 and the upper end surfaces 5*a* of both of the metal pins 5 therefore bite into the metal plate 6. FIG. 3B illustrates a state in which the metal plate 6 is substantially absent on the upper end surfaces 5*a* of both of the metal pins 5 and the metal plate 6 makes contact with the end portions of the side surfaces of the metal pins 5 at the side of the upper end surfaces 5*a*.

The joining strength in the joint portions can be further increased by forming the joint portions between both of the metal pins 5 and the metal plate 6 into the above-described shape.

Second Embodiment

Figure 4A:
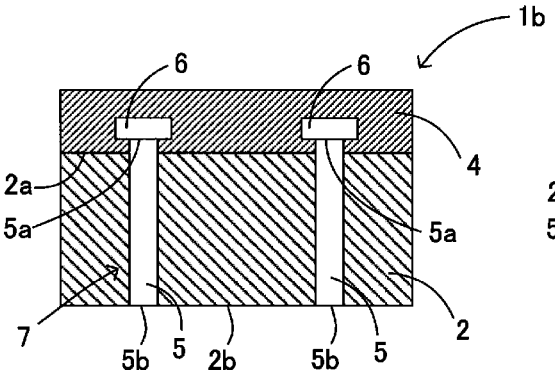
FIGS. 4A and 4B Each of FIGS. 4A and 4B is a cross-sectional view of an inductor component according to a second embodiment of the disclosure.
Figure 4B:
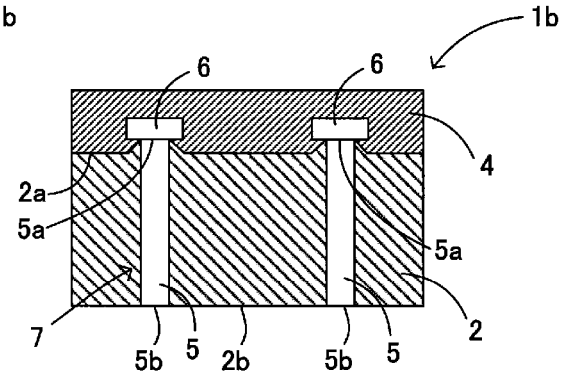

An inductor component 1*b* according to a second embodiment of the present disclosure will be described with reference to FIGS. 4A and 4B. FIGS. 4A and 4B are cross-sectional views of the inductor component 1*b*.

The inductor component 1*b* according to this embodiment differs from the inductor component 1 according to the first embodiment described with reference to FIGS. 1A to 1E and 2A to 2D in that end portions of both of the metal pins 5, which include the upper end surfaces 5*a*, protrude from the upper surface 2*a* of the resin layer 2. Other configurations are the same as those of the inductor component 1 in the first embodiment, description thereof is therefore omitted while denoting the same reference signs.

In this embodiment, the inductor component 1*b* can be formed by hardening resin in a state in which the end portions of both of the metal pins 5, which include the upper end surfaces 5*a*, protrude from the surface of the resin in the process of arranging both of the metal pins 5 in the resin layer 2. Only both of the metal pins 5 may protrude as illustrated in FIG. 4A or slopes may be formed as the upper surface 2*a* of the resin layer 2 toward the upper end surfaces 5*a* of both of the metal pins 5 as illustrated in FIG. 4B.

(Method for Manufacturing Inductor Component)

Next, a method for manufacturing the inductor component 1*b* according to the second embodiment of the disclosure will be described with reference to FIGS. 5A to 5G. In the following description, one inductor component 1*b* is manufactured, as an example, for ease of description.

Alternatively, the plurality of inductor components 1*b* may be simultaneously manufactured by collectively forming the plurality of inductor components 1*b* in the same manner as the manufacturing method, which will be described below, and then, separating it into the individual inductor components 1*b*.

Figure 5A:
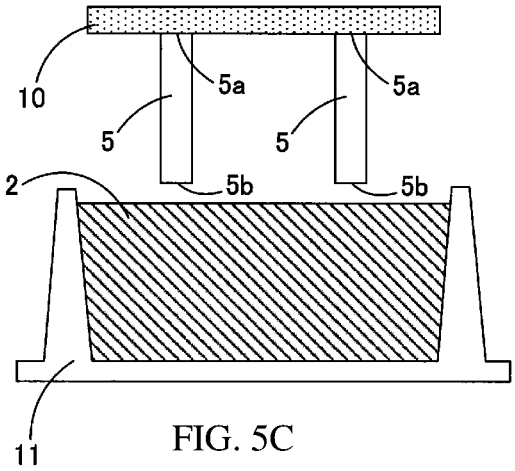
FIGS. 5A to 5G Each of FIGS. 5A to 5G is a view illustrating an example of a method for manufacturing the inductor component according to the second embodiment of the disclosure.
Figure 5B:
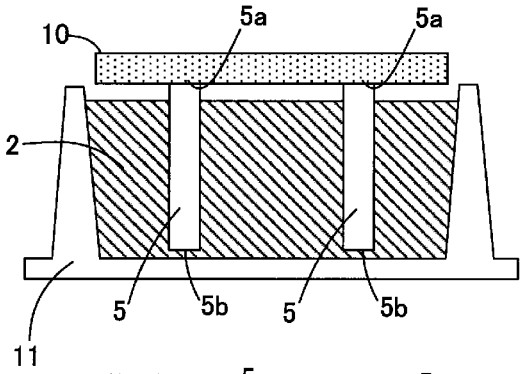

First, as illustrated in FIG. 5A, a transfer plate 10 with an adhesive layer (not illustrated) formed on one main surface thereof is prepared and the upper end surfaces 5*a* of the two metal pins 5 are attached to the adhesive layer, so that both of the metal pins 5 are provided to stand at predetermined positions on the one main surface of the transfer plate 10. Then, as illustrated in FIG. 5B, both of the metal pins 5 provided to stand on the transfer plate 10 are immersed in an unhardened magnetic material-containing resin filling a dam member 11 such that the end portions of the metal pins 5 are exposed from the surface of the resin. Then, the resin is thermally hardened to form the resin layer 2.

Figure 5C:
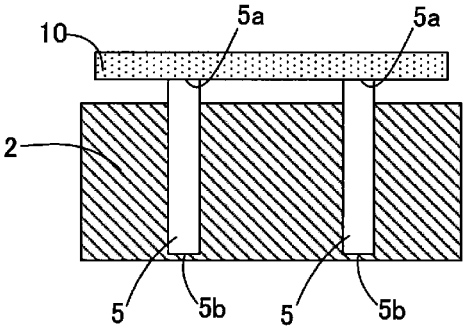
Figure 5D:
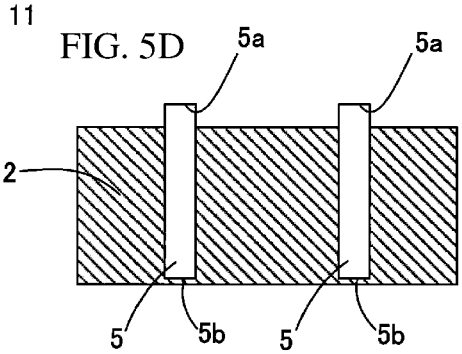
Figure 5E:
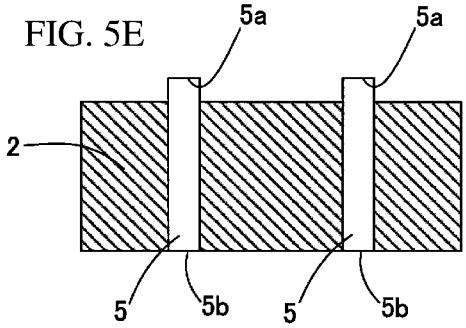

Subsequently, as illustrated in FIG. 5C, after the dam member 11 is removed, the transfer plate 10 is separated from the upper end surfaces 5*a* of both of the metal pins 5 as illustrated in FIG. 5D. Further, as illustrated in FIG. 5E, the lower end surfaces 5*b* of both of the metal pins are exposed to the surface of the resin layer 2 by removing the resin of the lower surface of the resin layer 2 (the surface opposite to the surface facing the protective film 4) by polishing or grinding. It should be noted that the adjustment of the amount of the resin may eliminate the necessity of the process of exposing the lower end surfaces 5*b* of the metal pins 5 by polishing or grinding in some cases.

Figure 5F:
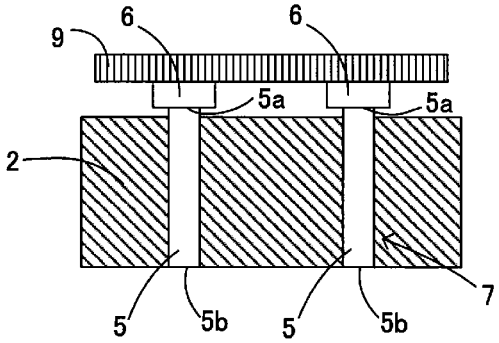
Figure 5G:
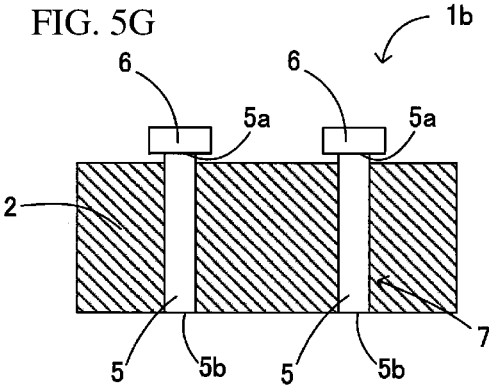

Then, as illustrated in FIG. 5F, the metal plate 6, which is mounted on the support member 9 and has been processed into a predetermined wiring pattern, is prepared, and the metal plate 6 and the upper end surfaces 5*a* of both of the metal pins 5 are joined to each other by ultrasonic waves to form the inductor electrode 7. Thereafter, as illustrated in FIG. 5G, the support member 9 is removed to complete the inductor component 1*b*. It should be noted that the metal plate 6 and the upper end surfaces 5*a* of both of the metal pins 5 may be joined to each other using solder.

According to this embodiment, the upper end surfaces 5*a* of both of the metal pins 5 protrude from the upper surface 2*a* of the resin layer 2. Therefore, not only the vibration energy in the ultrasonic joining can be efficiently applied to the joint portions between the metal pins 5 and the metal plate 6 but also both of the metal pins 5 and the metal plate 6 can be easily positioned in the joining.

Third Embodiment

Figure 6A:
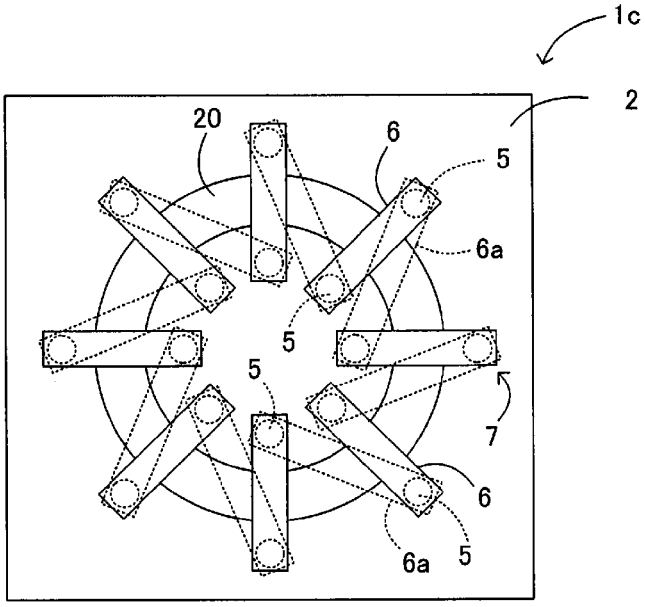
FIGS. 6A to 6E Each of FIGS. 6A to 6E is a plan view and a cross-sectional view of an inductor component according to a third embodiment of the disclosure.

An inductor component 1*c* according to a third embodiment of the present disclosure will be described with reference to FIGS. 6A to 6E. FIG. 6A is a plan view of the inductor component 1*c* and FIGS. 6B to 6E are cross-sectional views of the inductor component 1*c*.

The inductor component 1*c* according to this embodiment differs from the first and second embodiments in that the inductor component 1*c* includes an annular coil core 20 embedded in the resin layer 2 and that the inductor electrode 7 is spirally wound around the coil core 20 to form a toroidal coil. In the following description, the points different from those of the above-described first and second embodiments will be mainly described, the same reference signs will denote the same components as those in the above-described first and second embodiments and description thereof will be omitted.

As illustrated in FIG. 6A, the inductor electrode 7 includes the plurality of metal pins 5 and a plurality of metal plates 6 and 6*a* each having a rectangular shape. To be specific, the metal pins 5 include those aligned along the inner circumference of the coil core 20 and those aligned along the outer circumference thereof so as to form a plurality of pairs with the former ones. Each of the metal pins 5 is provided to stand in the resin layer 2 in a state in which the upper end surface 5*a* is exposed to the upper surface 2*a* of the resin layer 2 and the lower end surface 5*b* is exposed to the lower surface 2*b* of the resin layer 2. Each of the plurality of metal plates 6 arranged on the upper surface 2*a* of the resin layer 2 has one end arranged at the inner circumference side of the coil core 20 and the other end arranged at the outer circumference side thereof, and connects the upper end surface 5*a* of the metal pin 5 at the inner circumference side and the upper end surface 5*a* of the metal pin 5 at the outer circumference side, the metal pins 5 forming the pair. On the other hand, each of the plurality of metal plates 6*a* arranged on the lower surface 2*b* of the resin layer 2 has one end arranged at the inner circumference side of the coil core 20 and the other end arranged at the outer circumference side thereof, and connects the lower end surface 5*b* of one metal pin 5 at the inner circumference side and the lower end surface 5*b* of the metal pin 5 at the outer circumference side, the metal pin 5 being adjacent, at a predetermined side (in the embodiment, counterclockwise direction side), to the metal pin 5 at the outer circumference side, which forms the pair with the one metal pin 5. With this connection configuration, the toroidal coil in which the inductor electrode 7 is spirally wound around the annular coil core 20 is formed.

The protective film 4 similar to that in the first embodiment is arranged also on the lower surface 2*b* of the resin layer 2 (see FIGS. 6B to 6E). Further, insulators 21 are arranged between the respective metal plates 6*a* arranged on the lower surface 2*b* of the resin layer 2 and the coil core 20 (see FIGS. 6B to 6D).

In this embodiment, the resin layer 2 contains no magnetic filler and is made of general thermosetting resin such as epoxy resin. As in the above-described embodiments, the material of the resin layer 2 is not limited to the thermosetting resin such as the epoxy resin.

In addition, in this embodiment, in order to securely join the end surfaces 5*a* and 5*b* of both of the metal pins 5 and the metal plates 6 and 6*a* to each other, the positional relationships between the end surfaces 5*a* and 5*b* of both of the metal pins 5 and the resin around the peripheral edges thereof are made into any of those illustrated in FIGS. 6B to 6E as in the inductor component 1 in the first embodiment and the variations thereof.

Figure 6B:
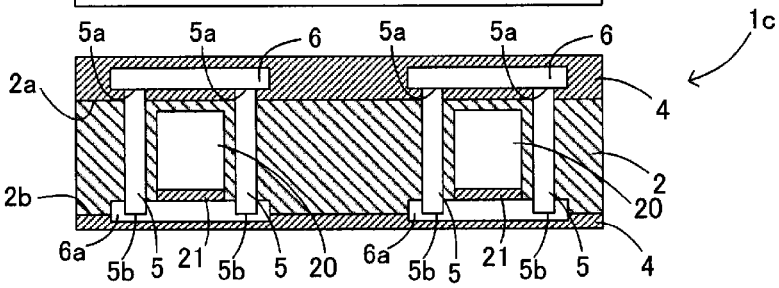

For example, in FIG. 6B, the end portions of the respective metal pins 5, which include the upper end surfaces 5*a*, are provided in a state of protruding from the upper surface 2*a* of the resin layer 2. Further, in the resin layer 2 at the lower surface 2*b* side, the metal plates 6*a* are connected to the lower end surfaces 5*b* of the metal pins 5 in a state in which parts of the metal plates 6*a* enter the inside of the resin layer 2. In this case, the lower end surfaces 5*b* of the respective metal pins 5 and the metal plates 6*a* are joined to each other in a state in which the lower end surfaces 5*b* bite into the metal plates 6*a*.

Figure 6C:
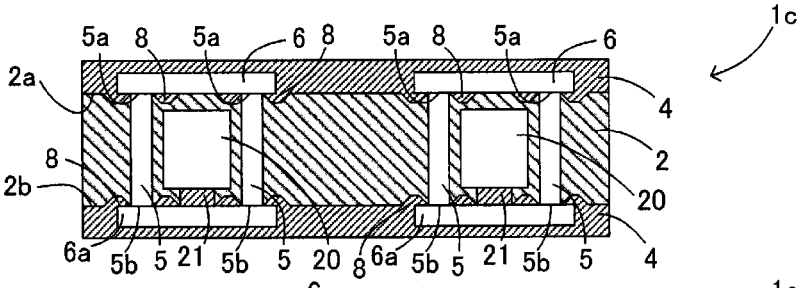
Figure 6D:
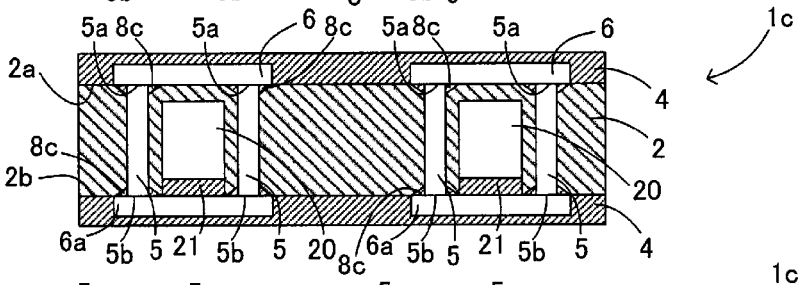
Figure 6E:
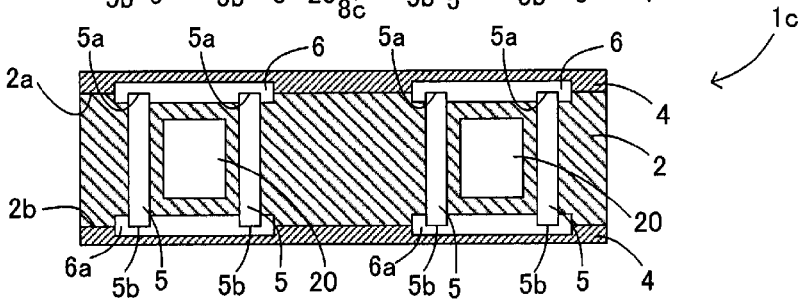
Figure 7:
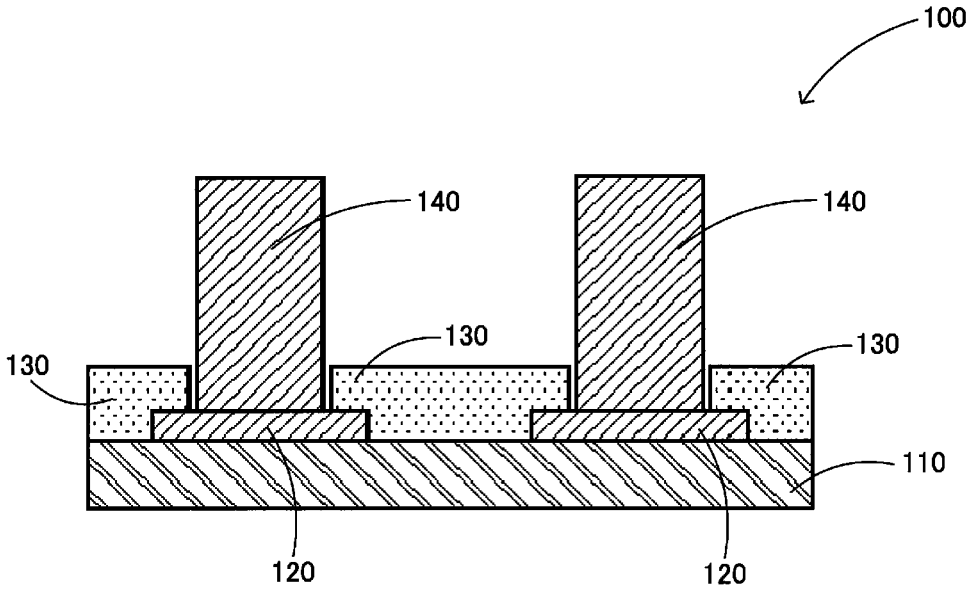
FIG. 7 is a view illustrating an existing method for joining electrode pads and metal pins.

In FIG. 6C, the recesses 8 are formed around the peripheral edges of both of the end surfaces 5*a* and 5*b* of the respective metal pins 5 as in FIG. 1B. In FIG. 6D, the cone-shaped recesses 8*c* are formed around both of the end surfaces 5*a* and 5*b* of the respective metal pins 5 as in FIG. 1E. In FIG. 6E, parts of the metal plates 6 and 6*a* enter the inside of the resin layer 2, and both of the end surfaces 5*a* and 5*b* of the respective metal pins 5 bite into the metal plates 6 and 6*a*, respectively as in FIG. 3A.

The inductor component 1*c* can be manufactured in the same manner as the manufacturing method described with reference to FIGS. 2A to 2D. In this case, when the metal pins 5 are covered by the resin in the process illustrated in FIG. 2A, the coil core 20 is arranged between the metal pins 5, and then, the resin layer 2 is formed. Thereafter, the inductor component 1*c* is manufactured in the same manner preferably.

According to the above-described embodiment, the same effects as those in the first embodiment can be provided in the configuration in which the inductor electrode 7 forms the toroidal coil.

The present disclosure is not limited by the above-described embodiments, and various other changes than those described above can be made without departing from the gist of the disclosure. For example, in the above-described third embodiment, no coil core 20 may be arranged.

The present disclosure can be widely applied to an inductor component including an inductor provided in a resin layer and a method for manufacturing the inductor component.

1, 1*a* to 1*c* INDUCTOR COMPONENT
2 RESIN LAYER
5 METAL PIN
6, 6*a* METAL PLATE
7 INDUCTOR ELECTRODE
8, 8*a* to 8*c* RECESS

The invention claimed is:

1. An inductor component comprising:
a resin layer; and
an inductor electrode,
wherein the inductor electrode has:
a metal pin provided to stand in the resin layer in a state in which an end surface of the metal pin is exposed to a main surface of the resin layer; and
a metal plate for wiring being in contact with the end surface of the metal pin,
the metal pin is disposed such that the end surface of the metal pin protrudes to at least a part of the main surface of the resin layer around a peripheral edge of the end surface of the metal pin, and
wherein an entire portion of the metal plate except for a portion of the metal plate contacting with the metal pin is arranged on or above an upper surface of the resin layer.

2. The inductor component according to claim 1, wherein an end portion of the metal pin including the end surface of the metal pin protrudes from the main surface of the resin layer.

3. The inductor component according to claim 1,
wherein the end surface of the metal pin includes an upper end surface of the metal pin, and
wherein a recess is provided in at least a part of the main surface of the resin layer around the peripheral edge of the upper end surface of the metal pin.

4. The inductor component according to claim 3,
wherein solder is arranged in the recess.

* * * * *